US011459853B2

(12) United States Patent
Green et al.

(10) Patent No.: US 11,459,853 B2
(45) Date of Patent: Oct. 4, 2022

(54) AUTONOMOUS CONTROL VALVE FOR WELL PRESSURE CONTROL

(71) Applicant: Swellfix UK Limited, Westhill (GB)

(72) Inventors: Annabel Green, Aberdeenshire (GB); John Hunter, Westhill (GB); Clint Frost, Aberdeenshire (GB)

(73) Assignee: Swellfix UK Limited, Aberdeenshire (GB)

( * ) Notice: Subject to any disclaimer, the term of this patent is extended or adjusted under 35 U.S.C. 154(b) by 0 days.

(21) Appl. No.: 15/779,215

(22) PCT Filed: Nov. 28, 2016

(86) PCT No.: PCT/GB2016/053730
§ 371 (c)(1),
(2) Date: May 25, 2018

(87) PCT Pub. No.: WO2017/089834
PCT Pub. Date: Jun. 1, 2017

(65) Prior Publication Data

US 2018/0347312 A1 Dec. 6, 2018

(30) Foreign Application Priority Data

Nov. 27, 2015 (GB) ..... 1521012
May 24, 2016 (GB) ..... 1609093

(51) Int. Cl.
*E21B 34/06* (2006.01)
*E21B 43/26* (2006.01)
(Continued)

(52) U.S. Cl.
CPC ..... *E21B 34/066* (2013.01); *E21B 34/14* (2013.01); *E21B 43/12* (2013.01); *E21B 43/14* (2013.01);
(Continued)

(58) Field of Classification Search
CPC ..... E21B 34/066; E21B 34/14; E21B 43/12; E21B 43/14; E21B 43/16; E21B 74/06;
(Continued)

(56) References Cited

U.S. PATENT DOCUMENTS 2,963,089 A 12/1960 Sizer
5,957,207 A * 9/1999 Schnatzmeyer ..... E21B 34/06 166/386
(Continued)

FOREIGN PATENT DOCUMENTS

EP 0910725 A1 4/1999
EP 2374993 A1 * 10/2011 ..... E21B 34/066
(Continued)

OTHER PUBLICATIONS

C. Zerbst et al., "Completing the First Big-Bore Gas Wells in Lunskoye—A Case History", Sakhalin Energy Investment Company Limited, Dec. 2011, pp. 462-472.
(Continued)

*Primary Examiner* — Matthew R Buck
*Assistant Examiner* — Patrick F Lambe
(74) *Attorney, Agent, or Firm* — Harness, Dickey & Pierce, P.L.C.

(57) ABSTRACT

A downhole flow control device is described having a flow control valve and a sensor communication with the flow control valve. The sensor measures a downstream process parameter and the flow control valve is configured to control the fluid flow through the valve to achieve a target downstream process parameter value in response to the measured downstream process parameter. A control system for controlling the downhole flow control device and a method for controlling the downhole flow device are also provided.

20 Claims, 4 Drawing Sheets

(51) Int. Cl.

| | |
|---|---|
| ***E21B 43/14*** | (2006.01) |
| ***E21B 43/12*** | (2006.01) |
| ***E21B 47/07*** | (2012.01) |
| ***E21B 34/14*** | (2006.01) |
| ***E21B 47/06*** | (2012.01) |
| ***E21B 49/08*** | (2006.01) |

(52) U.S. Cl.
CPC ..... *E21B 43/26* (2013.01); *E21B 47/06* (2013.01); *E21B 47/07* (2020.05); *E21B 49/08* (2013.01); *E21B 2200/06* (2020.05)

(58) Field of Classification Search
CPC ... E21B 74/065; E21B 49/08; E21B 2043/007
USPC ..... 166/316
See application file for complete search history.

(56) References Cited

U.S. PATENT DOCUMENTS

| | | | | |
|---|---|---|---|---|
| 5,992,519 | A | 11/1999 | Ramakrishnan et al. | |
| 6,276,458 | B1 * | 8/2001 | Malone | E21B 21/10 166/240 |
| 6,715,558 | B2 * | 4/2004 | Williamson | E21B 34/14 166/374 |
| 7,575,058 | B2 * | 8/2009 | Franco | E21B 34/14 166/334.4 |
| 10,995,584 | B2 * | 5/2021 | Noel | E21B 47/07 |
| 2008/0017373 | A1 | 1/2008 | Jones et al. | |
| 2010/0243243 | A1 | 9/2010 | Chen et al. | |
| 2015/0009039 | A1 * | 1/2015 | Tinnen | E21B 47/18 340/850 |
| 2016/0265300 | A1 * | 9/2016 | Affleck | E21B 47/06 |

FOREIGN PATENT DOCUMENTS

| | | | |
|---|---|---|---|
| GB | 2402954 | A | 12/2004 |
| GB | 2531025 | A | 4/2016 |
| WO | WO-2006/041308 | A2 | 4/2006 |
| WO | WO-2006/041309 | A1 | 4/2006 |
| WO | WO-2008/131218 | A2 | 10/2008 |
| WO | WO-2009/033146 | A2 | 3/2009 |
| WO | WO-2014/118503 | A1 | 8/2014 |
| WO | WO-2016/055451 | A1 | 4/2016 |
| WO | WO-2016114766 | A1 | 7/2016 |

OTHER PUBLICATIONS

International Search Report for PCT/GB2016/053730, PCT/ISA/210 Dated Mar. 29, 2017.
Written Opinion of the International Searching Authority for PCT/GB2016/053730, PCT/ISA/237 Dated Mar. 29, 2017.
European Examination Report for corresponding Application No. 16808741.9 dated Apr. 28, 2020.

* cited by examiner

AUTONOMOUS CONTROL VALVE FOR WELL PRESSURE CONTROL

CROSS-REFERENCE TO RELATED APPLICATIONS

This is a national phase under 35 U.S.C. § 120 to, PCT International Application No. PCT/GB2016/053730, which has an international filing date of Nov. 28, 2016 which claims priority to United Kingdom Application No. 1521012.3, filed Nov. 27, 2015 and United Kingdom Application No. 1609093.8, filed May 24, 2016 the entire contents of each of which are hereby incorporated by reference.

FIELD

The present disclosure relates to a flow control device, particularly a downhole flow control device and a method of controlling a flow control device.

BACKGROUND

Oil and gas fields typically comprise a number of wells which are processed by the same processing facility. The well conditions of each well may be different, for example, different wells may have different pressures. These differences can be due to, for example, penetrating different sections of the reservoir or different reservoir units. The variation in pressure can result in an imbalance of production across the wells.

Advanced completions or intelligent wells use valves or chokes in the reservoir that can be operated from the surface. These can be used to address or minimise the effect of imbalanced production across a formation.

Intelligent completion technology can be controlled from the surface using multiple hydraulic and/or electric control lines which have to pass through the wellhead into the completion annulus and run along the entire production line to where the valves are located. There are limitations associated with the use of control lines including the high costs associated with the equipment, complexity and risk during deployment.

Wireless intelligent completions utilise electronic controlled interval control valves which include sensors and in well processors which enables remote operation and control of the completion by the operator from the surface. Wireless telemetry, for example pressure pulses, is used to send and receive signals from downhole units to the surface. The ability of the downhole control valve to react to changes in the well environment remains in the hands of the operator on the surface.

During hydraulic fracturing operations, adjacent and nearby wells have to be isolated from the area being fractured. The wellhead is typically rated and designed to maintain a seal to isolate the well, however in practice a second barrier is usually provided to ensure pressure integrity. Two independent barriers for well control is normal practice and the second barrier is typically in the form of a retrievable plug installed downhole. After completion of the hydraulic fracturing operation, the plug is milled out. Any well within 0.5 to 1 mile of the fracking operation is required to be protected in this manner and it may be required to carry out this operation 4 or 5 times per well. The costs of plugging and milling can quickly build up during a hydraulic fracturing operation.

SUMMARY

According to an aspect of the present disclosure, there is provided a downhole flow control device comprising:

a flow control valve;

a sensor in communication with the flow control valve, wherein the sensor measures a local process parameter; and wherein the flow control valve is configured to control the fluid flow through the valve to achieve a target local process parameter value in response to the measured local process parameter.

In use, the downhole flow control device provides a means for monitoring and autonomously controlling the fluid production from a well. The flow control device will respond directly to changes in the downhole environment by changing the flow path through the valve as well conditions change without intervention from the surface of the well.

A local process parameter may be a process parameter measured in the vicinity of the flow control device. For example, the sensor may measure the downhole pressure at the location of the flow control device, and/or may measure the pressure drop across the flow control device, or measure the downhole pressure at the location of the flow control device.

The downhole flow control device may control the fluid flow through the flow control valve independently from external instruction, wherein external instruction comprises, for example, communication from the surface of the well, and/or input from an operator.

The downhole flow control device may be autonomous.

The local process parameter may be, for example, the downstream pressure, pressure drop across flow control valve, temperature, viscosity, or fluid composition, for example water content, measured in the vicinity of the flow control device when located downhole.

The target local process parameter value may be selected to maintain a surface process parameter of the well at a desired value or within a desired range.

The surface process parameter may be, for example, surface pressure or fluid flow rate.

For example, the local process parameter may be pressure and the target local process parameter value may be selected to maintain the surface pressure of the well.

The target local process parameter value may be determined through nodal analysis, for example nodal analysis may be performed on the well to determine a target process parameter value to produce a desired surface condition such as well head pressure.

The target local process parameter value may be programmed prior to deployment of the flow control device downhole.

The target local process parameter value may be reprogrammable whilst the flow control device is in-situ. This increases the flexibility of the device to adjust to changing well conditions.

The target local process parameter value may be reprogrammed using downhole wireless communication such as wireless telemetry. This allows the flow control device to be re-programmable without the need for removal of the device from the well.

The flow control device may comprise wireless communication technology such as that described in WO2006/041308 and/or WO2006/041309. The flow control device may comprise a receiver and transmitter unit enabling it to be reconfigured using wireless telemetry.

Reconfiguring the flow control device may comprise a command to shutdown.

The local process parameter may be the same process parameter as the target process parameter, or it may be a different process parameter. For example, the target process parameter may be flow rate and the local process parameter may be pressure.

The flow control device may be configured to maintain the target downstream pressure at a predetermined level to keep the surface pressure at or below a predetermined level. The sensor may be selected to measure the local process parameter, for example a pressure sensor or a temperature sensor. The sensor may be chosen to measure any local process parameter, for example, pressure, temperature, flow rate, viscosity, fluid composition.

The flow control device may comprise a plurality of sensors configured to measure different local process parameters, for example a pressure sensor and temperature sensor.

The flow control device may be re-configurable to respond to different process parameters. For example, the flow control device may be configured to respond to a pressure reading from the sensor to achieve a target local pressure value, and the flow control device may be reconfigured to respond to a temperature reading and a pressure reading from temperature and pressure sensors to achieve a target downhole flowrate.

The flow control valve may comprise a choke valve.

The valve may comprise an electro-mechanical actuator, for example a piston or a sleeve.

The valve may be motor driven.

The valve may comprise a housing, wherein a piston is configured to extend and retract into or out of the housing to alter the flow area of the valve.

The valve may comprise an infinitely variable choke actuator.

The size of the flow control valve may be selected based on computational fluid dynamics (CFD) analysis performed to determine the range of valve size required to achieve the target local process parameter value.

A range of valve size may be preferable over a fixed valve size to account for declining reservoir pressure.

The flow control valve may further comprise a seal to facilitate the valve maintaining a seal when in a closed position.

The flow control device may comprise an electronics module.

The electronics module may act as a controller for the flow control valve.

The electronics module may act as the controller for the sensor.

The sensor and flow control valve may be controlled by a shared electronics module.

The electronics module may comprise an on-board processor.

The flow control device may use the target local process parameter value as a reference in a closed loop control system.

In use, the sensor may measure the local process parameter at set intervals. The processor may compare the measured local process parameter value with the target local process parameter value to determine if the actual local process parameter needs to be adjusted; the flow control valve may then alter the fluid flow through the valve to achieve the target local process parameter value.

The intervals may be selected depending on the process, for example measurements may be taken in second intervals, minute intervals, hour intervals, day intervals or week intervals.

The sensor may be configured to continuously measure the local process parameter as the flow control valve changes the fluid flow through the valve to achieve the target local process parameter value. The term "continuously" may comprise taking measurements at set intervals, where the intervals are short, for example taking a measurement every second, every five seconds, every 10 seconds. When the target local process parameter value has been reached, the flow control device may be configured to instruct the flow control valve to hold its position.

The flow control device may be configured to remain open until production is started. The flow control device may be located inside downhole tubing. This may allow for the flow control device to be retrievable.

The flow control device may be configured to form part of a downhole tubing string.

The tubing may be production tubing.

The flow control device may be located at any location within the production tubing, for example, the flow control device may be located to avoid hydrate formation. The flow control device may be located in the heel of the production tubing.

The flow control device may be an inflow control valve (ICV) for use in a production well.

The flow control device may be an inflow control valve for use in isolating at least a portion of the production well. For example, the flow control device may be used in hydraulic fracturing operations to isolate a distal portion of the well while hydraulic fracturing takes place in adjacent or nearby wells.

In use as an isolation valve, the target process parameter may be no fluid flow, or no fluid flow path or any process parameter associated with the flow valve being closed. The local process parameter may be, for example pressure or flow. The flow control valve may be configured such that when a pressure is detected within an accepted value or range, the flow control valve may close. The flow control valve may be configured such that when a flow rate of zero flow is detected, the flow control valve may close.

The flow control device may be configured to act as an isolation valve prior to running in hole.

The flow control device may be reconfigured to act as an isolation valve whilst in-situ downhole.

The flow control device may be designed to withstand a pressure up to a desired pressure value required to isolate the well, for example but not limited to, 8,000 psi, 10,000 psi.

A production well may be shut-in, for example from the surface, to stop production of the well. This may comprise closing a valve located at or near the surface of the production well. When a production well is shut-in, the downhole pressure at or near the flow control valve may increase.

The flow control device may be configured to detect when a shut-in of the well has taken place.

The flow control device may be configured to remain open until a shut-in of the well is detected. This may allow fluid flow through the flow control device during production of the well.

The flow control device may be used during the production of the well as a flow control device to maintain a desired surface process parameter and may be configured to be reconfigured whilst in-situ to be used as an isolation valve. For example the flow control device may be reconfigured using wireless telemetry to change the target process parameter to close the valve in response to a shut-in. The flow control device may be configured to measure the local pressure at set intervals. The intervals may be selected depending on the process, for example measurements may be taken in second intervals, minute intervals, hour intervals, day intervals or week intervals.

In use as an isolation valve, when a well is shut-in, the flow control device may detect an elevated local pressure. For example, an elevated pressure reading over a minimum period of time may indicate that the well has been closed and the flow control device may reconfigure to achieve the target process parameter of no fluid flow path through the valve.

The flow control device may be configured to recognise an elevated pressure value or increased pressure differential across the valve detected over a minimum time to be associated with a well shut-in. The minimum time may be, for example one minute, five minutes, ten minutes, fifteen minutes, twenty minutes, one hour, or any appropriate time interval required by the flow control device.

The flow control device may reconfigure to a closed position in response to a pressure indicating a shut-in of the well.

When the target local process parameter value has been reached, the valve may be closed and the flow control device may be configured to instruct the flow valve to hold this configuration.

In the closed position, the flow control device may maintain a seal and isolate at least a portion of the well, for example a distal portion of the well.

The flow control device may be configured to measure the local pressure whilst the flow control device is closed, for example, the flow control device may measure the local pressure at set intervals, for example every minute, or every five minutes, every ten minutes, every hour or any suitable interval, or the flow control device may be configured to measure the local pressure continuously whilst the flow control device is closed. The term "continuously" may comprise taking measurements at set intervals, where the intervals are short, for example taking a measurement every second, every five seconds, every 10 seconds.

The flow control device may be configured to open when the wellhead is opened, for example, after hydraulic fracturing operations have been completed.

The flow control device may be configured to open when the local pressure value above or below the valve corresponds to a value or within a pressure range associated with the well being open, or when a predetermined pressure differential across the valve is detected.

The flow control device may be configured to open or remain open when the local pressure is outside of an accepted range or value associated with the well being shut-in or associated with hydraulic fracturing operations occurring in adjacent or nearby wells, or the flow control device may be configured to open when the local pressure is within an accepted range associated with the well being open or hydraulic fracturing operations being complete. For example, when the well is opened or if hydraulic fracturing operations in nearby wells are stopped, the local pressure may decrease and the flow control device may be configured to respond to this pressure decrease by opening the flow control valve. A reduction in pressure measured over a minimum period of time may indicate that the well has been opened and the flow valve may open allowing the well to resume production.

The flow control device may be configured to remain closed until the flow control device is instructed to open, for example at such time as hydraulic fracturing operations in adjacent or nearby wells have been completed.

Instructing the flow control device to open may comprise sending a signal to the flow control device, for example using wireless telemetry. For example, a pressure signal from the surface of the well may be sent to the flow control device when the well is opened following a shut-in, or in preparation for the well being opened following a shut-in. Upon receiving this pressure signal, the flow control device may open.

The flow control device may be configurable between an active and a passive configuration. In the passive configuration, the flow control device may measure a local process parameter, and compare the local process parameter to a target process parameter to, for example, determine whether the actual local process parameter needs to be adjusted. In the active configuration, the flow control valve may alter the fluid flow through the valve to achieve the target local process parameter value.

The flow control device may be configured to the active configuration during well shut-in. Additionally, or alternatively, the flow control device may be configured to the active configuration during production and/or when the wellhead is opened. The flow control device may be configured to the passive configuration once the target process parameter has been reached.

In the passive configuration, the flow control valve may not require to be altered. As such, in the passive configuration, the flow control device may consume less power than in the active configuration, thereby extending battery life, for example.

The flow control device may be configured to reset following opening after a shut-in such that the flow control device may remain open until another shut-in is detected.

The flow control device may be powered by a local power source.

The flow control device may be battery powered. The number of batteries may be selected according to the desired lifetime of the flow control device, for example one battery, two batteries, three batteries, or four batteries. The number of batteries may be limited by the rig-up height and handling of the flow control device.

The flow control device may be powered by a downhole generator. For example, the flow control device may be powered by a turbine for energy extraction from fluid flowing within a conduit, such as that described in UK patent publication number 2531025 and/or WO2016/055451 and/or WO2014118503.

According to a second aspect of the present disclosure, there is provided a control system for a downhole flow control device comprising:

a closed loop control system wherein a flow control valve located downhole adjusts to achieve a target local process parameter value in response to a measured local process parameter reading from a sensor in communication with the flow control valve.

The control system may comprise a plurality of sensors in communication with the flow control valve.

Each sensor may measure a different process parameter.

The target local process parameter value may be a reference in the closed loop control system.

The control system may be configured such that the sensor measures the downhole process parameter at set intervals. For example, the sensor may be configured to take measurements in second intervals, minute intervals, day intervals, week intervals or month intervals.

The control system may be configured to continuously measure the local process parameter as the flow valve adjusts the fluid flow through the valve to achieve the target local process parameter value. The term "continuously" may comprise taking measurements at set intervals, where the intervals are short, for example taking a measurement every second, every five seconds, every 10 seconds. When the target local process parameter value has been reached, the control system may be configured to instruct the flow valve to hold its position. The control system may be configured to be reprogrammable when required by well conditions, for example the target downhole process parameter value may be changed, the downhole process parameter may be changed, and the flow control valve may be shut down.

The control system may be reprogrammable whilst the downhole flow control device is in-situ.

The control system may be reprogrammable using downhole wireless telemetry, for example the wireless communication technology such as that described in WO2006/041308 and/or WO2006/041309.

The control system may be configured to set the flow control device to idle whilst no flow is detected. The control system may comprise an outer loop and an inner loop.

The outer loop may detect if the well is flowing and whether or not any communication is due to be received or sent from the flow control device. When flow is detected, the control system may move to the inner loop.

The inner control loop may determine if the measured downhole process parameter is within an accepted tolerance for the target local process parameter value and may adjust the flow valve accordingly. If the measured downhole process parameter is within the accepted tolerance for the target process parameter, the control system may move back to the outer loop.

The outer loop may measure a local downhole process parameter to determine whether the well has been shut-in at or near the surface. For example, an elevated local pressure over a minimum time may signal that the well has been shut-in. When a shut-in is detected, the control system may move to the inner loop. If no shut-in is detected, the outer control loop may take local downhole process parameters at set intervals.

The inner control loop may have a target local process parameter of no fluid flow, or no fluid flow path, or any process parameter associated with the flow control valve being closed. When the control system moves to the inner control loop, the control system may reconfigure the flow valve to achieve the target process parameter, for example the flow control valve will close.

The inner loop may measure the downhole process parameter at set intervals and whilst the downhole process parameter is within an accepted range, instruct the flow control valve to remain closed. If the downhole process parameter is not within the accepted range, the inner loop may instruct the flow valve to open and the control system may return to the outer loop.

For example, the downhole process parameter may be pressure. The inner loop may determine if the measured pressure or pressure differential across the flow control valve is within an accepted range for the flow valve to remain closed. The inner loop may determine if the measured pressure or pressure differential across the valve is within an accepted range for the flow valve to open. The accepted range may be a pressure or pressure range associated with the well being shut in or a pressure range associated with hydraulic fracturing operations taking place in adjacent or nearby wells, or the accepted range may be a pressure value or range associated with the wellhead being open, or associated with hydraulic fracturing operations being completed. If the inner loop determines the detected pressure value is below the accepted range or within the accepted range, the inner loop may instruct the flow control valve to open. For example, a decrease in local pressure to a pressure below the accepted range or within the accepted range, or a decrease in differential pressure across the valve may indicate that the wellhead has been opened and the flow valve can be opened.

The control system may be operable to set the flow control valve between the active configuration and the passive configuration. When the flow control valve is in the active configuration, the control system may operate using the inner loop. When the flow control valve is in the passive configuration, the control system may operate using the outer loop.

The control system may be configured to receive a communication from surface to open the flow valve. For example, a communication sent from the surface using wireless telemetry. The communication may be in the form of a pressure signal. Upon receipt of the communication, the control system may instruct the flow vale to open and the control system may return to the outer control loop.

Features described in relation to the flow control device of the first aspect apply mutatis mutandis to the second aspect.

According to a third aspect of the present disclosure, there is provided a method of controlling a downhole flow control device comprising:

programming a downhole flow control device with a target local process parameter value;

locating the downhole flow control device downhole, wherein the device comprises a flow control valve and a sensor in communication with the flow valve;

measuring a local process parameter with the sensor;

wherein the flow valve controls the fluid flow through the valve to achieve the target local process parameter in response to the measured local process parameter.

The method may be used to control fluid production from a well.

The method may comprise locating the downhole flow control device in production tubing, wherein the downhole flow device may form part of the tubing or be located inside the tubing.

The method may comprise a closed loop control system wherein the target local process parameter value is a reference.

The method may comprise reconfiguring the flow control device if necessary according to well conditions, for example the target downhole process parameter value may be changed, the downhole process parameter may be changed, and the flow control valve may be shut down.

The method may comprise reconfiguring the flow control device whilst the flow control device is in situ.

The method may comprise reconfiguring the flow control device using downhole wireless communication such as wireless telemetry, for example the wireless communication technology such as that described in WO2006/041308 and/or WO2006/041309.

The method may comprise operating the flow control valve during production of the well, for example where the target process parameter is selected to obtain a predetermined rate of production of the well. The target process parameter may be, for example pressure, temperature, flow rate and viscosity. The local process parameter detected by the sensor may be, for example pressure, temperature, flow rate and viscosity. The local process parameter may be the same or different from the target process parameter.

The method may comprise operating the flow control valve as an isolation valve. In use as an isolation valve, the target process parameter may be no fluid flow, or no fluid flow path or any process parameter associated with the flow control valve being closed. The local process parameter may be pressure and the flow control valve may be configured such that when a pressure is detected within an accepted value or range, the flow control valve may close.

The method may comprise configuring the flow control device to operate as an isolation valve prior to running in hole.

The method may comprise configuring the flow control device to operate as an isolation valve whilst in-situ downhole.

The method may comprise isolating a portion of a well, for example a distal portion of the well.

The flow control device may be used to isolate a portion of the well during hydraulic fracturing operations to isolate a portion of the well while adjacent or nearby wells are being fractured.

The method may comprise detecting when the well has been shut-in. For example, the local process parameter may be pressure and the method may comprise the sensor measuring the downhole pressure. The method may comprise measuring the local pressure at set intervals. The intervals may be selected depending on the process, for example measurements may be taken in second intervals, minute intervals, hour intervals, day intervals or week intervals. An elevated pressure detected over a minimum period of time may indicate that the well has been closed and the flow valve may adjust to achieve the target process parameter of no fluid flow, wherein the fluid flow valve will close.

The method may comprise reconfiguring the flow control valve to a closed position to achieve the target local process parameter of zero flow, or zero fluid flow path in response to a pressure indicating a shut-in of the well.

The method may comprise maintaining the flow control valve in the closed position to isolate and seal a portion of the production well. The flow control valve may be designed to withstand a required pressure to isolate the well, for example but not limited to 8,000 psi or 10,000 psi.

The method may comprise opening the valve, for example when the well is opened. For example when a valve at the wellhead has been opened.

The method may comprise detecting when the well has been opened.

The method may comprise detecting if the measured local pressure or pressure differential is within an accepted range for the flow control valve to remain closed. The accepted range may be a pressure range associated with the well being shut in from surface or a pressure range associated with hydraulic fracturing operations taking place in adjacent wells. For example, when a well is shut-in, the pressure at or near the flow control valve may increase.

The method may comprise detecting if the measured local pressure or pressure differential across the valve is within an accepted range for the flow valve to open. The accepted range may be a reduced pressure range or pressure differential associated with the wellhead being open, or associated with hydraulic fracturing operations being completed.

The method may comprise determining if the measured pressure value is below the accepted range or within the accepted range and opening the flow control valve open. For example, a decrease in local pressure to a pressure below the accepted range or to within the accepted range may indicate that the wellhead has been opened and the flow valve can be opened.

The method may comprise sending a signal, for example a wireless communication to the flow control device to open the valve. For example, a pressure pulse sent from the surface may trigger the flow control valve to reopen.

The method may comprise operating the flow control valve during production of the well and reprogramming the flow control valve in-situ to operate as an isolation valve. The method may comprise operating the flow control valve as an isolation valve and reconfiguring the flow valve in-situ to operate during production of the well.

Features described in relation to the flow control device of the first aspect and the control system of the second aspect apply mutatis mutandis to the method of the third aspect.

According to a fourth aspect of the present disclosure, there is provided a downhole flow control device for isolating a portion of a well, the flow control device comprising:

a flow control valve;

a sensor in communication with the flow control valve, wherein the sensor measures a local process parameter; and wherein the flow control valve is configured to close in response to the measured local process parameter.

In use, the downhole flow control device provides a means to isolate a portion of a well independently from external instruction, wherein external instruction comprises, for example, communication from the surface of the well, and/or input from an operator.

The flow control device may be autonomous.

The flow control device may be configured to isolate a portion of the well, for example a distal portion of the well during hydraulic fracturing operations on adjacent or nearby wells.

A local process parameter may be a process parameter measured in the vicinity of the flow control device. For example, the sensor may detect the downhole pressure at the location of the flow control device, and/or may measure the pressure drop across the fluid control device, or measure the downhole pressure at the location of the flow control device.

The local process parameter may be, for example, the downstream pressure or pressure drop across flow control valve measured in the vicinity of the flow control device when located downhole.

The flow control device may be located inside downhole tubing. This may allow for the flow control device to be retrievable.

The flow control device may be configured to form part of a downhole tubing string.

The tubing may be production tubing.

The flow control device may be located at any location within the production tubing, for example the flow control device may be located in the production tubing above the hydrocarbon bearing formation such that a distal portion of the well is isolated when the flow control valve is closed.

The flow control device may be an inflow control valve for use in isolating a portion of a production well. For example, the flow control device may be used to isolate a portion of the well while hydraulic fracturing takes place in adjacent or nearby wells.

In use as an isolation valve, the local process parameter may be, for example pressure or flow. The flow control valve may be configured such that when a pressure is detected within an accepted value or range, the flow control valve may close. The flow control valve may be configured such that when a flow rate of zero flow is detected, the flow control valve may close.

The flow control device may be configured to act as an isolation valve prior to running in hole.

The flow control device may be reconfigured to act as an isolation valve whilst in-situ downhole.

The flow control device may be designed to withstand a pressure up to a desired pressure value required to isolate the well, for example but not limited to, 8,000 psi, 10,000 psi.

A production well may be shut-in, for example from the surface, to stop production of the well. This may comprise closing a valve located at or near the surface of the production well. When a production well is shut-in, the downhole pressure may increase and fluid flow will be zero.

The flow control device may be configured to detect when a shut-in of the well has taken place.

The flow control device may be configured to remain open until a shut-in of the well is detected. This may allow fluid flow through the flow control device during production of the well.

The flow control device may be used during the production of the well as a flow control device to maintain a desired surface process parameter and may be configured to be reconfigured whilst in-situ to be used as an isolation valve. For example the flow control device may be reconfigured using wireless telemetry to change the target process parameter to achieve a closed valve in response to a shut-in. The flow control device may be configured to measure the local pressure at set intervals. The intervals may be selected depending on the process, for example measurements may be taken in second intervals, minute intervals, hour intervals, day intervals or week intervals.

In use as an isolation valve, when a well is shut-in, the flow control device may detect an elevated local pressure. For example, an elevated pressure reading over a minimum period of time may indicate that the well has been closed and the flow control device may reconfigure to achieve the target process parameter of no fluid flow path through the valve.

The flow control device may be configured to recognise a pressure value or pressure differential across the valve detected over a minimum time to be associated with a well shut-in. The minimum time may be, for example one minute, five minutes, ten minutes, fifteen minutes, twenty minutes, one hour, or any appropriate time interval required by the flow control device.

The flow control device may reconfigure to a closed position in response to a pressure indicating a shut-in of the well.

The flow control device may be configured to instruct the flow valve to hold this configuration.

In the closed position, the flow control device may maintain a seal and isolate at least a portion of the well, for example a distal portion of the well.

The flow control device may be configured to measure the local pressure whilst the flow control device is closed, for example, the flow control device may measure the local pressure at set intervals, for example every minute, or every five minutes, every ten minutes, every hour or any suitable interval, or the flow control device may be configured to measure the local pressure continuously whilst the flow control device is closed. The term "continuously" may comprise taking measurements at set intervals, where the intervals are short, for example taking a measurement every second, every five seconds, every 10 seconds.

The flow control device may be configured to open when the wellhead is opened, for example, after hydraulic fracturing operations have been completed.

The flow control device may be configured to open when the local pressure value above or below the valve corresponds to a value or within a pressure range associated with the well being open, or when a predetermined pressure differential across the valve is detected.

The flow control device may be configured to open or remain open when the local pressure is outside of an accepted range or value associated with the well being shut-in or associated with hydraulic fracturing operations occurring in adjacent or nearby wells, or the flow control device may be configured to open when the local pressure is within an accepted range associated with the well being open or hydraulic fracturing operations being complete. For example, when the well is opened or if hydraulic fracturing operations in nearby wells are stopped, the local pressure may decrease and the flow control device may be configured to respond to this pressure decrease by opening the flow control valve. A reduction in pressure measured over a minimum period of time may indicate that the well has been opened and the flow valve may open allowing the well to resume production.

The flow control device may be configured to remain closed until the flow control device is instructed to open, for example at such time as hydraulic fracturing operations in adjacent or nearby wells have been completed.

Instructing the flow control device to open may comprise sending a signal to the flow control device, for example using wireless telemetry. For example, a pressure signal from the surface of the well may be sent to the flow control device when the well is opened following a shut-in, or in preparation for the well being opened following a shut-in. Upon receiving this pressure signal, the flow control device may open.

The flow control device may be configured to reset following opening after a shut-in such that the flow control device may remain open until another shut-in is detected.

The flow control device may be reconfigured for use during production of the well. For example, the flow control device may be reconfigured to have a target local process parameter which is selected to maintain a desired surface process parameter. The flow control device may reconfigure the fluid flow path to achieve the target local process parameter is response to the measured local process parameter. The measured local process parameter may be reprogrammed whilst the flow valve is in-situ.

The target local process parameter value and the local process parameter may be reconfigured using downhole wireless communication such as wireless telemetry. This allows the flow control device to be re-configurable without the need for removal of the device from the well.

The flow control device may comprise wireless communication technology such as that described in WO2006/041308 and/or WO2006/041309. The flow control device may comprise a receiver and transmitter unit enabling it to be reprogrammed using wireless telemetry.

The flow control valve may comprise a choke valve.

The valve may comprise an electro-mechanical actuator, for example a piston or a sleeve.

The valve may be motor driven.

The valve may comprise a housing, wherein a piston is configured to extend and retract into or out of the housing to alter the flow area of the choke valve.

The valve may comprise an infinitely variable choke actuator.

The size of the flow control valve may be selected based on computational fluid dynamics (CFD) analysis performed to determine the range of valve size required to achieve the target local process parameter value.

A range of valve size may be preferable over a fixed valve size to account for declining reservoir pressure.

The flow control valve may further comprise a seal to facilitate the valve maintaining a seal when in a closed position.

The flow control device may comprise an electronics module.

The electronics module may act as a controller for the flow control valve.

The electronics module may act as the controller for the sensor.

The sensor and flow control valve may be controlled by a shared electronics module.

The electronics module may comprise an on-board processor.

The flow control device may be powered by a local power source.

The flow control device may be battery powered. The number of batteries may be selected according to the desired lifetime of the flow control device, for example one battery, two batteries, three batteries, or four batteries. The number of batteries may be limited by the rig-up height and handling of the flow control device.

The flow control device may be powered by a downhole generator. For example, the flow control device may be powered by a turbine for energy extraction from fluid flowing within a conduit, such as that described in UK patent publication number 2531025 and/or WO2016/055451 and/or WO2014118503.

Features described in relation to other aspects of the present disclosure apply mutatis mutandis to the flow control vale of the fourth aspect.

According to another aspect of the present disclosure, there is provided a method of isolating a portion of a well during hydraulic fracturing operations, the method comprising locating a flow control valve downhole, closing the well;

closing flow control valve; and performing hydraulic fracturing operations on an adjacent or nearby well.

The method may further comprise measuring a downhole process parameter with a sensor in communication with the flow control valve, wherein the flow control valve will close in response to the measured downhole process parameter.

The flow control valve may close without intervention from the surface of the well.

The downhole process parameter may be, for example pressure or flow.

The method may comprise detecting a pressure within an accepted value or range and closing the flow control valve.

The method may comprise detecting no fluid flow and closing the flow control valve.

The method may further comprise closing the well at or near the surface, for example by closing a valve located at or near the surface of the well.

The method may comprise detecting when a shut-in of the well has taken place.

The method may comprise configuring the flow control valve to remain open until a shut-in of the well is detected.

The method may further comprise producing through the valve. The method may further comprise producing when the valve is in an open or partially open configuration. The method may comprise configuring the flow control valve to maintain a desired surface process parameter, for example a pre-determined flow rate or pressure.

The method may comprise detecting an elevated local pressure and closing the flow control valve. For example, an elevated pressure reading over a minimum period of time may indicate that the well has been closed and the flow control device may close.

The method may comprise recognising a pressure value or pressure differential across the valve detected over a minimum time to be associated with a well shut-in. The minimum time may be, for example one minute, five minutes, ten minutes, fifteen minutes, twenty minutes, one hour, or any appropriate time interval required by the flow control device.

The method may comprise maintaining the flow control valve in the closed configuration. In the closed configuration, the flow control valve may maintain a seal and isolate at least a portion of the well, for example a distal portion of the well.

The method may comprise detecting the local pressure whilst the flow control valve is closed, for example, the flow control device may detect the local pressure at set intervals, for example every minute, or every five minutes, every ten minutes, every hour or any suitable interval, or the flow control valve may be configured to detect the local pressure continuously whilst the flow control valve is closed. The term "continuously" may comprise taking measurements at set intervals, where the intervals are short, for example taking a measurement every second, every five seconds, every 10 seconds.

The method may further comprise opening the flow control valve. For example, the method may comprise opening the flow control valve after hydraulic fracturing operations on the adjacent or nearby well have been completed.

The method may comprise opening the flow control valve when the local pressure value above or below the valve corresponds to a value or within a pressure range associated with the well being open, or when a predetermined pressure differential across the valve is detected.

The method may comprise opening or holding the flow control valve open when the local pressure is outside of an accepted range or value associated with the well being shut-in or associated with hydraulic fracturing operations occurring in adjacent or nearby wells, or opening or holding the flow control valve open when the local pressure is within an accepted range associated with the well being open or hydraulic fracturing operations being complete. For example, when the well is opened or if hydraulic fracturing operations in nearby wells are stopped, the local pressure may decrease and the flow control valve may be configured to respond to this pressure decrease by opening the flow control valve. A reduction in pressure measured over a minimum period of time may indicate that the well has been opened and the flow valve may open allowing the well to resume production.

The method may comprise maintaining the flow control valve in the closed configuration until the flow control device is instructed to open, for example at such time as hydraulic fracturing operations in adjacent or nearby wells have been completed.

The method may further comprise instructing the flow valve to open. Instructing the flow control valve to open may comprise sending a signal to the flow control valve, for example using wireless telemetry. For example, a pressure signal from the surface of the well may be sent to the flow control valve when the well is opened following a shut-in, or in preparation for the well being opened following a shut-in. Upon receiving this pressure signal, the flow control device may open.

The method may further comprise reconfiguring the flow control valve to maintain a pre-determined production rate from the well. For example the flow control device may be reconfigured using wireless telemetry.

The method may comprise configuring the flow control valve between the active and passive configuration.

The method may comprise configuring the flow control valve to the active configuration during well shut-in.

Features described in relation to other aspects of the present disclosure apply mutatis mutandis to the method described in this aspect.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

Figure 1A:
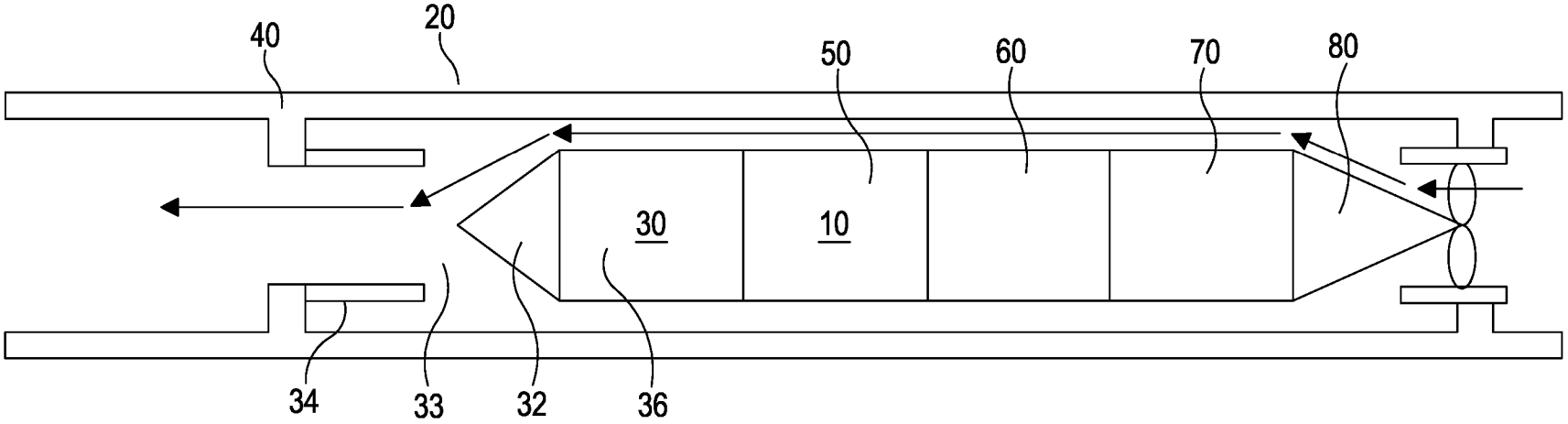
FIG. 1A shows a schematic cut-away diagram of an in-line flow control device according to the present disclosure.

The downhole flow control device 10 in use is deployed within a wellbore which intercepts a subterranean formation which contains hydrocarbons. In the embodiment shown in FIGS. 1*a* and 1*b*, the flow control device 10 is deployed inside production tubing 20, configured to communicate fluids, such as gas, produced from the formation to the surface. Alternatively, the flow control device can form part of the production tubing, and will be run as part of the completion, either directly attached to the tail pipe or with the completion itself, as shown in FIGS. 2*a* and 2*b*.

The flow control device 10 has a flow control valve 30 in the form of a choke valve with an infinitely variable choke system. Choke valve 30 has an electro-mechanical piston 32 and a choke housing 34. The position of the piston 32 with respect to the choke housing forms a choke inlet 33. The valve 30 has a drive mechanism and motor 36 to move the piston of the choke valve. The flow control device has a sensor module 50 containing sensors to measure the desired process parameter. The skilled person will appreciate that the sensors may be chosen to measure any downhole process parameter, for example, pressure, temperature, flow rate, viscosity, fluid composition. The sensors 55 are in communication with a sensor module 50 in the flow control device 10. An on-board electronics processor module 60 is present which controls both the sensors and the choke valve. The device 10 has a battery module 70 to provide power for the flow control device 10. The number of batteries selected will determine the lifetime of the valve. The batteries are thionyl chloride batteries, although any suitable batteries may be utilised. The number of batteries used is limited by the rig-up height and handling of the flow control device but the more batteries used the longer the life time of the flow control device, particularly in low temperature wells.

In addition to the battery module 70, the flow control device has a power generator 80. The power generator may be similar to that described in in UK patent publication number 2531025 and/or WO2016/055451 and/or WO2014118503. The skilled person will recognise that the flow control device may have either a battery module or a power generator or both as required by the intended use and design constraints of the flow control device.

Packers 40 will be present in the production tubing 20 between the flow control device 10 and the production tubing to isolate and seal the flow control device 10.

Figure 2A:
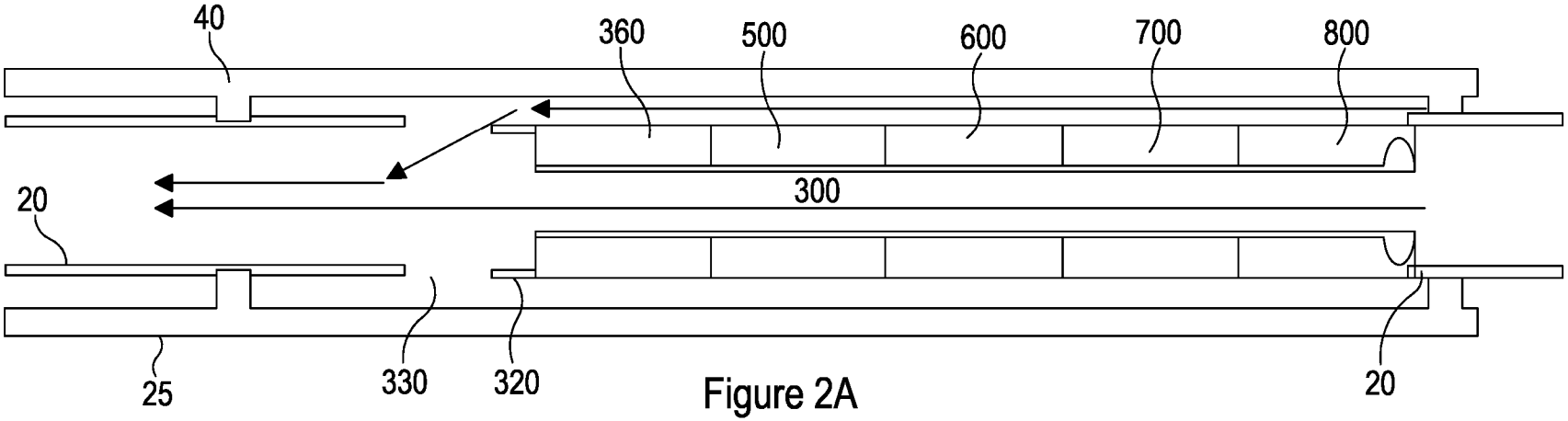
FIG. 2A shows a schematic cut-away diagram of an annular flow control device according to the present disclosure.
Figure 2B:
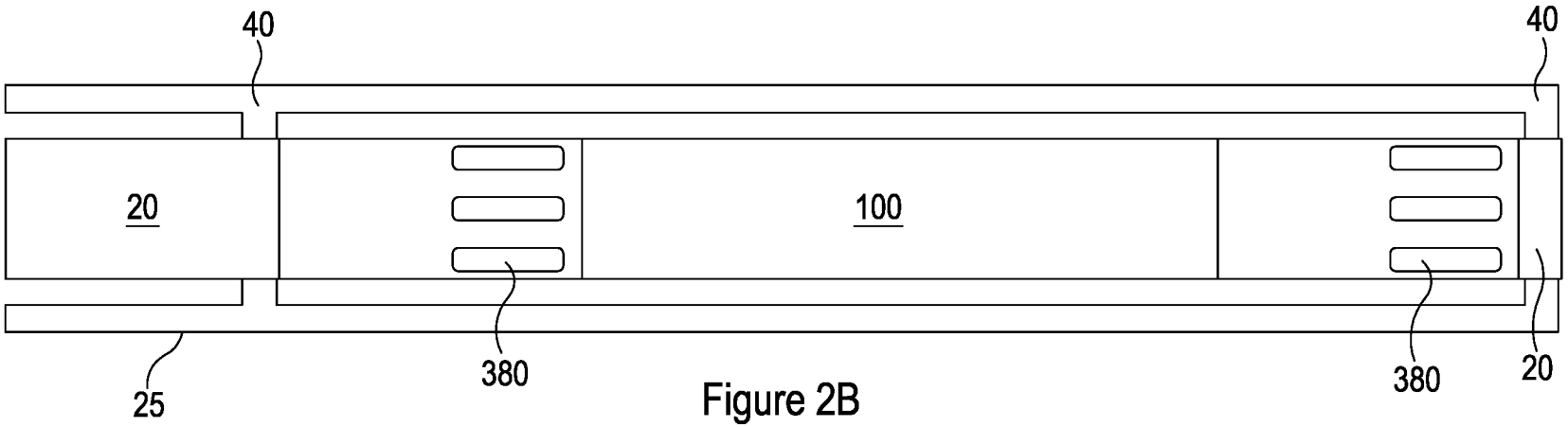
FIG. 2B shows a schematic diagram of the flow control device of FIG. 2A.

The fluid flow through the flow control device 10 is shown by the arrows in FIG. 1*a*. As the piston 32 is moved away from or towards the choke housing 34, this increases or reduces the size of the choke inlet 33 and the fluid flow area through the valve 30 will be changed.

Figure 1B:
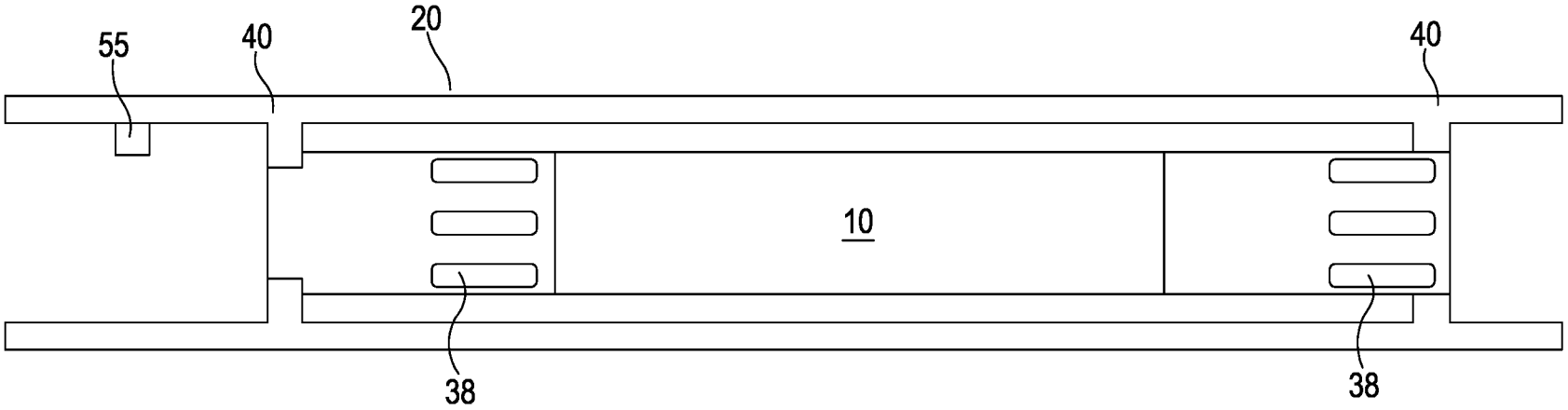
FIG. 1B shows a schematic diagram of the flow control device shown in FIG. 1A.

The flow control device 10 in position within the production tubing can also be seen in FIG. 1*b* where flow ports 38 allowing fluid to flow into the valve are located at the upstream and downstream ends of the flow control device 10.

The flow control device 100 in FIG. 2 is an annular flow control device 100 deployed as part of the production tubing 20 within downhole casing 25. The flow control device 100 has a flow control valve 300 in the form of a choke valve with an infinitely variable choke system. Choke valve 300 has an electro-mechanical variable position sleeve 320. The position of the sleeve 320 with respect to tubing 20 forms a choke inlet 330. The valve 300 has a drive mechanism and motor 360 to move the sleeve 320 towards or away from the tubing 20 reducing or increasing the size of the choke inlet 330. Similarly to the in-line embodiment of FIGS. 1*a* and 1*b*, the flow control device 100 has a sensor module 500 containing sensors to measure the desired process parameter. Again, the skilled person will appreciate that the sensors may be chosen to measure any downhole process parameter, for example, pressure, temperature, flow rate, viscosity, fluid composition. The sensors 550 are in communication with a sensor module 500 in the flow control device 100. The sensors and choke valve are controlled by a shared on board electronics processor module 600. The device 100 has a battery module 700 to provide power for the flow control device 100 and a power generator module 800. The batteries are thionyl chloride batteries, although any suitable batteries may be utilised and the power generator may be similar to that described in in UK patent publication number 2531025 and/or WO2016/055451 and/or WO2014118503. The skilled person will recognise that the flow control device may have either a battery module or a power generator or both as required by the intended use and design constraints of the flow control device.

Packers 40 are present in the casing 25 between the production tubing 20 and casing 25 to isolate and seal the flow control device 100. The flow through the flow control device 100 is shown by the arrows in FIG. 2*a*. As the sleeve 320 is moved towards or away from the production tubing 20, this reduces or increases the size of the choke inlet 330 and the fluid flow area through the valve 30 will be adjusted.

The flow control device 100 in positon as part of the production tubing 20 located within casing 25 can also be seen in FIG. 2*b* where flow ports 380 allowing fluid to flow into the valve are located at the upstream and downstream ends of the flow control device 10.

The flow control device 10, 100 is installed and located downhole. The location of the flow control device is selected to minimise hydrate formation. In this embodiment, the flow control device is installed at the heel of the well, where higher temperatures and pressures make hydrate formation unlikely. One skilled in the art will recognise that the flow control device may be installed at any location downhole as required by the particular production process.

The flow control device is programmed 10, 100 to target specific downhole well conditions in the vicinity of the flow control device, for example downstream pressure or choke pressure drop, prior to installation of the flow control device. The target local process parameter value is selected based on nodal analysis modelling to produce, for example, a required wellhead pressure. In this embodiment, the flow control device is programmed to have a target downstream pressure, although the skilled person will appreciate that any process parameter may be selected as the measured and target process parameter, for example, temperature, pressure, flow rate, viscosity, fluid composition.

The flow control device is autonomous. That is to say, the flow control device works by responding directly to a change in the environment of the well to change the flow path. The flow control device is programmed to maintain the target downstream pressure to keep the surface pressure at a manageable rate. The flow control device uses a closed loop control system where the target downstream pressure is the reference.

Once installed, the flow control device will be dormant until the well is placed on production. When production is detected the sensors will sample the downhole pressure at set intervals and pass this reading to the on-board processor. The processor will compare the measured value with the value set as the target pressure, and decide if the pressure needs to be adjusted or maintained.

If the pressure needs to be adjusted the piston will extend or retract into the choke housing, altering the fluid flow area as it moves. As flow through the valve changes, so does the upstream and downstream pressure. The flow control device sensors will continuously monitor the upstream and downstream pressure as the piston moves, and upon reaching the target pressure, the on-board processor will instruct the choke valve to hold that position.

It will be clear to the persons skilled in the art that the target local process parameter may be any useful, and measurable downhole process parameter, for example temperature, pressure, viscosity, fluid composition such as water content.

The measurement intervals of the flow control device are programmed such that when the well is placed on production, measurements are taken frequently in order for the target downstream pressure to be achieved. During periods of stable production, measurement intervals will be further apart and the valve will intermittently adjust to maintain production within the target conditions. This provides for optimum production as well conditions change over time.

An event such as plugging due to solids will be detected as a reduction in downstream pressure. The flow control device will instruct the choke valve to open to allow the solids to clear the choke, and will then re-adjust the choke position to once again maintain the target downstream pressure.

The flow control device can be reprogrammed during operations without retrieving the device from downhole. The flow control device has a receiver and transmitter unit located within the on-board electronics processor module 60 which utilise data from the sensors 55, enabling it to be reprogrammed using wireless telemetry. Wireless telemetry encompasses wireless downhole data communication as known in the art, for example according to WO2006/041308 and WO2006/041309. Such reprogramming can include an adjustment to the target downstream pressure if required by changing well conditions, or a simple shutdown command.

Figure 3:
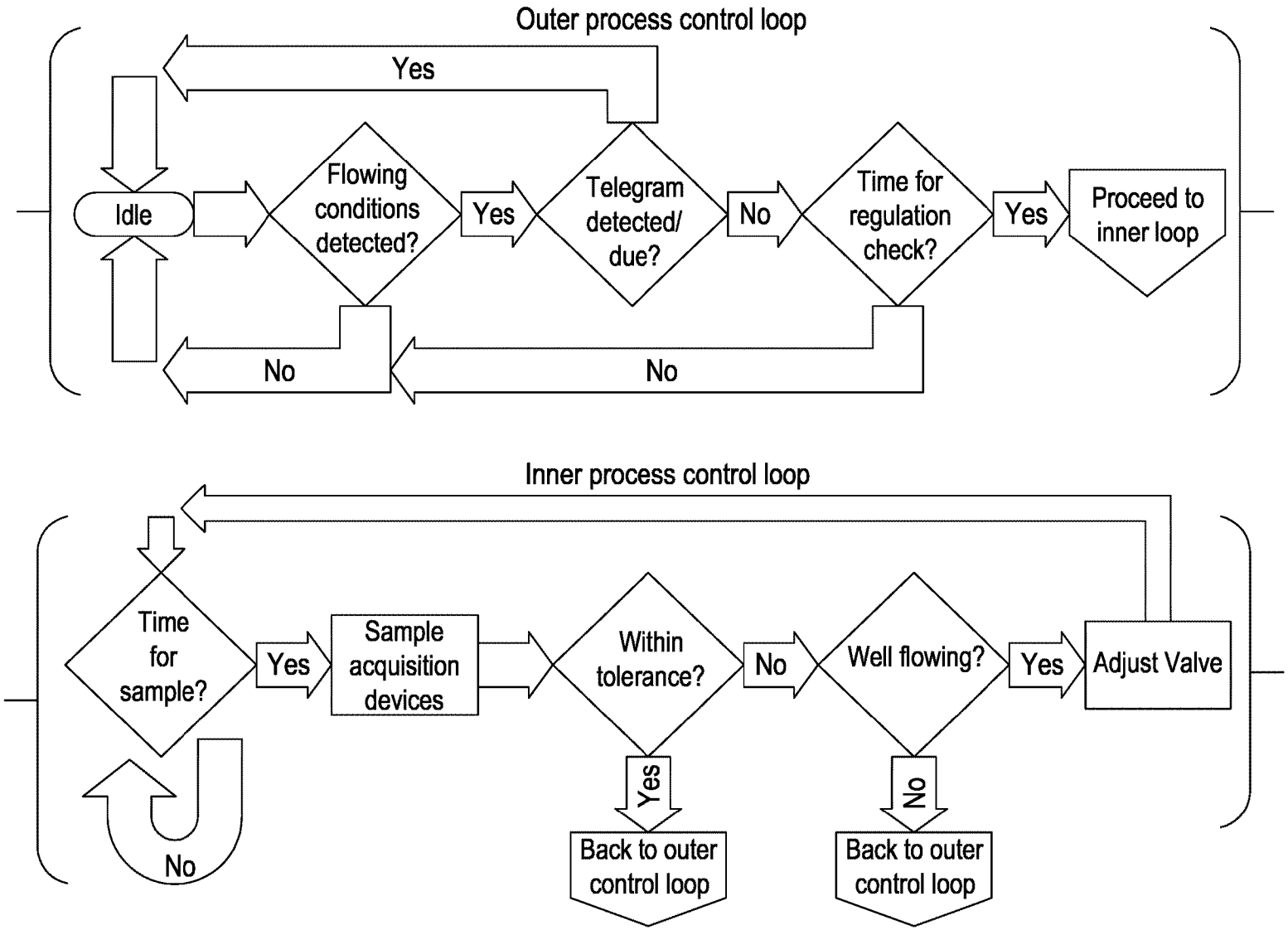
FIG. 3 shows a detailed schematic of the outer control and inner control loop for the fluid control device.

A detailed description of the control process for the fluid control device is shown in FIG. 3. The control process has two loops, an outer loop and an inner loop. The outer loop detects if the well is flowing and whether or not any communication is due to be received or sent from the flow control device. The inner control loop determines if the sampled data is within the accepted tolerance for the target process parameter value and adjusts the flow valve accordingly. A description of each block of the flow diagram is provided in Table 1. In some examples, control process of the fluid control device operating on the outer loop corresponds to the fluid control device having a passive configuration, while the fluid control device operating on the inner loop corresponds to the fluid control device having an active configuration.

In use, the flow control device is completely autonomous such that the choke valve will adjust the fluid flow area directly in response to the measured downstream pressure in order to meet the target downstream pressure. Aside from reprogramming, the flow control device will operate without any communication from the surface and therefore, in normal operating circumstances, will not require any input from an operator and will not require control or power lines from the surface. Further, the flow control device is configurable between an active and a passive configuration. In the passive configuration, the flow control device measures a local downstream process parameter at select intervals, and compares the local process parameter to a target process parameter, for example, to determine whether the actual local process parameter need to be adjusted. In the active configuration, the flow control valve alters the fluid flow through the valve to achieve the target local process parameter value.

Figure 4:
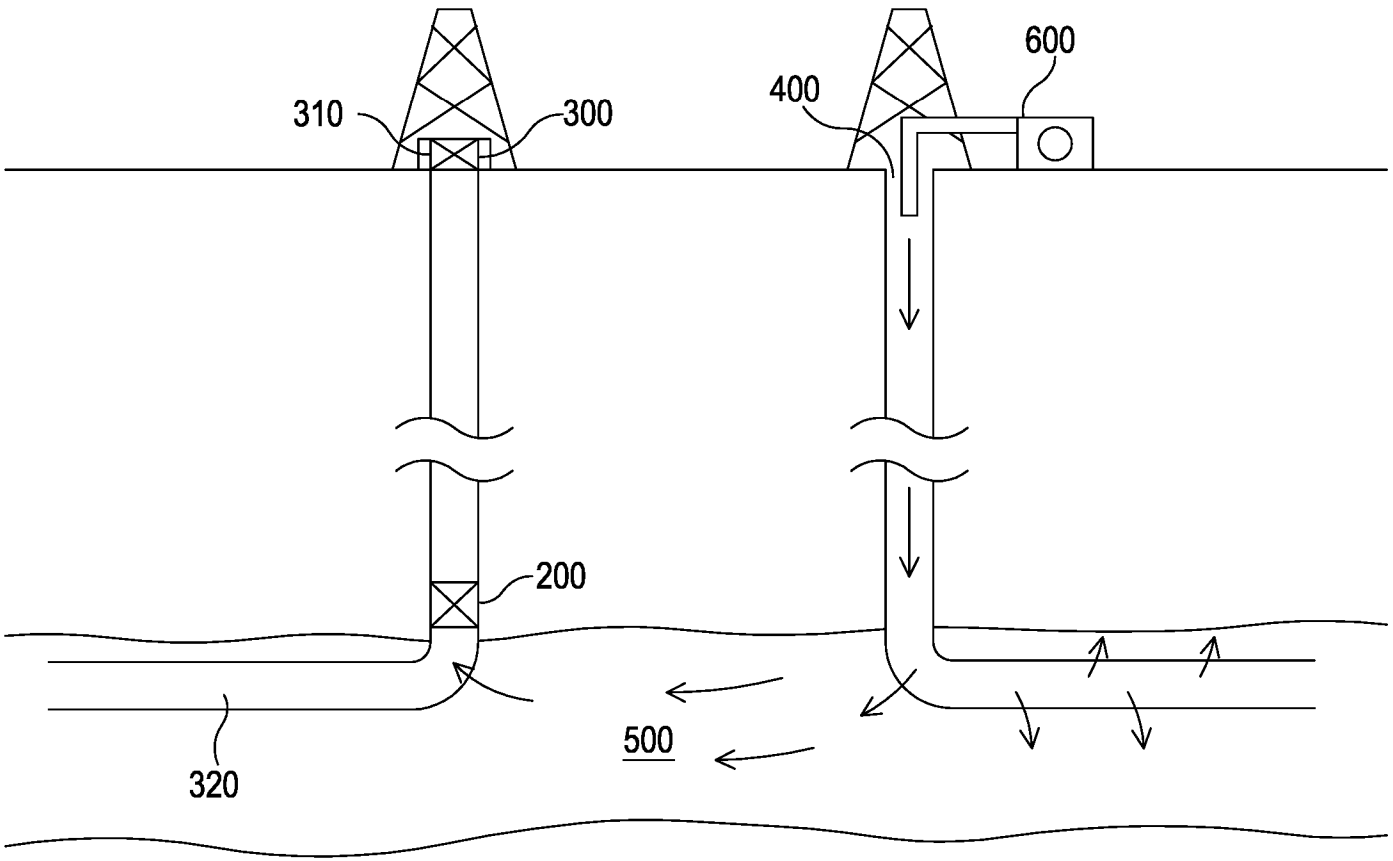
FIG. 4 shows a schematic of the flow control device of the present disclosure in use during a hydraulic fracturing operation.

FIG. 4 illustrates a schematic of production wells 300 and 400. The flow control device 200 can be used as an inflow control valve for use in isolating a distal portion 320 of a production well 300. The flow control device 200 may be required during hydraulic fracturing operations to isolate a portion of the well 300 while hydraulic fracturing operations 600 take place in adjacent well 400. The flow control valve 200 is designed to withstand pressures of up to 10,000 psi.

Whilst the flow control valve 200 is being run in hole, the on-board processor will ignore pressure changes measured by the sensors. Once at setting depth and following setting of the device, the sensors will detect production flow and choke the valve twice, at a fixed time interval apart. The pressure pulses detected at surface as a result of the valve choking confirm the flow control device is active. The flow control device will then remain open until a shut-in of the well is detected. Well 300 can be shut-in at surface by closing valve 310.

In use as an isolation valve, the flow control valve 200 has a target process parameter of no fluid flow path, that is the valve is closed and isolates the well. The sensors detect downhole pressure at set intervals and pass this reading to the on-board processor. The sensors are located within the sensor module of the flow control device and the reading is sent directly to the on-board processor which is also located downhole. Therefore, the valve can change the fluid flow path through the valve to achieve the target process parameter without intervention from the surface of the well. The processor will compare the measured value with a programmed value or range associated with the well being shut-in at the surface. When the well is shut-in, the downstream pressure will increase and the sensors will detect this pressure profile. The on-board processor is configured to recognise that an elevated pressure reading within an accepted range over a minimum period of time is associated with a shut-in of the wellhead and the on-board processor will instruct the valve to close. Thus, once the on-board processor recognises an elevated pressure reading, the flow control device 200 will configure from the passive configuration to the active configuration to close the flow control device 200. The rise in pressure associated with a shut-in is a preset value and the on board processor will detect if the rise in pressure has occurred and that the rise in pressure in maintained for preset period of time. For example, the on-board processor will look for a 15 bar increase in pressure that is maintained for at least 60 minutes. The increase in pressure could be more than 15 bar and could last infinitely. The preset values of pressure and time can be selected based on well analysis, reasoned judgements and estimates as appropriate for a particular production well.

Whilst the pressure readings detected by the sensors are outside of the accepted range or preset value, typically lower than the shut-in pressure, the flow control valve will remain open, allowing normal production of the well. In this manner, the flow control valve 200 will ignore any pressure variances that may result from, for example a downhole pump or a beam pump in the well and will close only when a shut-in is detected. Alternatively, the flow control valve 200 may be configured to detect production of the well as function of the difference between two pressure sensors and a shut-in would be detected when both sensors read the same or similar pressure.

When the valve has closed, the on-board processor will instruct the flow control valve to hold its position until valve 310 has been reopened or until the valve is instructed to open. The flow control valve will maintain an 8,000 psi static seal.

With both the surface valve 310 and flow control valve 200 closed, hydraulic fracturing operations can commence on neighbouring well 400. During hydraulic fracturing operations, high pressure fluid (indicated by the arrows in FIG. 4) is pumped into production well 400 by pump 600 and into the hydrocarbon bearing formation 500. Proximal portion 320 of production well 300 is isolated from the high pressure hydraulic fracturing fluid by the flow control valve 200. The flow control valve 200 may be configured to continue to detect the downhole pressure at set intervals whilst in the valve is closed and may be configured to react to pressure from the reservoir 500 due to hydraulic fracturing operations.

The flow control device is configured to remain closed until a communication is received from surface instructing the valve to open following completion of hydraulic fracturing operations. The communication is in the form of a pressure pulse signal or multiple pressure signals within a set interval sent from the surface and received by the receiver unit located within the on-board processor module 60. In this application, over pressure is applied from the surface at a specific value for a specific period of time, for example 20 bar for 30 minutes. The on-board processor will detect this over pressure and instruct the flow control valve to open after a pre-determined time delay. When multiple pressure pulse signals are sent to the flow control valve 200, the time gap between each signal can be used to instruct the time delay before opening, the speed of opening of the valve and/or the position of opening, for example instruct the valve to open fully or to an intermediate open configuration.

Alternatively, the flow control valve 200 may be configured such that when the well is opened at valve 310 and the pressure detected by the sensors decreases, the on-board processer may instruct the flow valve 200 to open when a pre-determined pressure differential across the valve is detected by the flow control valve, such as 3,000 psi or 500 psi, that is associated with the well being open. The flow control device will then reset to open and normal production of the well can resume until the next well shut-in is detected by the flow control device.

The flow control valve 200 is configured to recognise pressure changes associated with a shut-in, and therefore, the flow control valve 200 is configured to ignore the high pressures associated with a hydraulic fracturing operation such that it is possible to carry out hydraulic fracturing operations on a production well 300 with the flow control valve 200 installed. For example, a shut-in may result in a pressure change of between 15 and 30 bar and a hydraulic fracturing operation may be 300 to 600 bar; the flow control valve 200 is configured to recognise the associated pressure changes and will remain fully open during hydraulic fracturing operations of the well in which the valve 200 is installed.

The flow control device 200 can be configured act as an isolation valve and can be configured prior to running in hole to recognise and react to the specific pressure changes associated with a well shut-in and hydraulic fracturing operations, as described above. The flow control valve 200 can also be reconfigured whilst in-situ from the surface using wireless telemetry such that the preset pressure values are changed or to reconfigure the flow control valve to act as flow control device to maintain a surface production rate

TABLE 1

| Description of Process Control stages | |
|---|---|
| Outer process control loop | |
| Idle | The control system will wait on "Idle" in the outer control loop on a timer (typically daily) that will instruct the flow control device to check if the well is flowing, to detect/send pressure pulse telegrams, and to do a regulation check. |
| Flowing conditions detected | The flow control device will only move to the telegram check if the device detects flowing conditions. |
| Telegram detected/due | If flowing conditions are detected, the device will check to see if any communication from the surface has been detected or is due to be sent. If not, flow control device will move onto regulation check |
| Time for regulation check | The flow control device will check to see if it is due to regulate the valve parameters. If so, the flow control device will enter the inner process control loop. |
| Inner process control loop | |
| Time for sample | The inner loop will sample at a much higher frequency, typical in seconds. If time for a sample it will access the data from the attached sensors. |

TABLE 1-continued

| Description of Process Control stages | |
|---|---|
| Sample acquisition device | Processer will request and receive data from the attached sensors. |
| Within tolerance | The on-board processor will check to determine if the sampled data is within the pre-defined range for that parameter. If so, the device will go back to the outer loop. If not, the device will check if the well is flowing. |
| Well flowing | Shut in on surface can be detected by a build-up in tubing pressure. If the device detects this it will go back to the outer loop. If the flow control device detects the well is still flowing, the motor driving the piston/sleeve of the valve will be powered on to adjust the valve. |
| Adjust valve | The direction of the motor driving the valve will depend on whether the sample data is + or − of tolerance (moving the piston in or out of choke housing). The inner process control loop will continue until data is within tolerance or a shut in is detected, in which case the control system will return to idle on the outer control loop. |

The invention claimed is:

1. A method of operating a downhole flow control and isolating device in a production well, the method comprising:

locating the downhole flow control and isolation device within the well at a downhole location, wherein the device comprises a flow control valve and a sensor in communication with the flow control valve;

operating the flow control valve in a flow control configuration in which the flow control valve is adjusted between fully open, partially open and fully closed positions via an infinitely variable choke actuator, in response to a measured local process parameter so as to control a fluid flow through the valve during production from the well to achieve a target local process parameter value;

detecting that the measured local process parameter indicates that the well has been shut-in; and operating the flow control valve in an isolation configuration in which the flow control valve is closed so as to reduce flow therethrough and isolate a portion of the well at the downhole location.

2. The method of claim 1, further comprising:

reconfiguring the flow control valve from the isolation configuration to the flow control configuration in response to the measured process parameter indicative of the well producing.

3. The method of claim 1, further comprising:

closing the flow control valve in response to a pressure indicating a shut in.

4. The method of claim 1, further comprising:

detecting a pressure within an accepted value or range; and closing the flow control valve.

5. The method of claim 1, further comprising:

detecting a local pressure while the flow control valve is closed.

6. The method of claim 1, further comprising:

opening the flow control valve when a local pressure value above or below the valve is within a pressure range associated with the well being open.

7. A downhole flow control and isolation device for use in a production well, comprising:

a flow control valve locatable within the well at a downhole location, wherein the flow control valve is controlled by a processor, the processor configured to recognize a shut-in event;

a sensor in communication with the flow control valve, wherein the sensor is configured to measure a local process parameter within the well, the sensor being controlled by the processor;

wherein the flow control valve is configurable by the processor in a flow control configuration in which the flow control valve is adjusted between fully open, partially open and fully closed positions via an infinitely variable choke actuator, in response to the measured local process parameter to control a fluid flow through the valve during production from the well to achieve a target local process parameter value;

and wherein the flow control valve is reconfigurable by the processor to an isolation configuration in which the flow control valve is closed to reduce flow therethrough and isolate a portion of the well at the downhole location, the flow control valve being reconfigurable to the isolation configuration in response to the measured process parameter being indicative of the well being shut-in, as recognized by the processor.

8. The downhole flow control and isolation device of claim 7, wherein the fluid flow through the valve is adjusted independently from external instruction.

9. The downhole flow control and isolation device of claim 7, wherein the target local process parameter value is programmed prior to deployment of the flow control valve downhole.

10. The downhole flow control and isolation device of claim 7, wherein the flow control and isolation device uses the target local process parameter value as a reference in a closed loop control system.

11. The downhole flow control and isolation device of claim 7, wherein the sensor is configured to one of measure the local process parameter at set intervals, or measure the local process parameter continuously as the flow control valve adjusts the fluid flow through the valve to achieve the local process parameter value.

12. The downhole flow control and isolation device of claim 7, wherein the flow control and isolation device is configured to be located downhole at a location selected to reduce formation of hydrates.

13. The downhole flow control and isolation device of claim 7, wherein the flow control valve is reconfigurable from the isolation configuration to the flow control configuration in response to the measured process parameter being indicative of the well producing.

14. The downhole flow control and isolation device of claim 7, wherein the flow control valve is configured to remain closed, permitting no fluid flow, until the device is instructed to open.

15. The downhole flow control and isolation device of claim 7, configurable between an active configuration and a passive configuration.

16. The downhole flow control and isolation device of claim 15, wherein at least one of:

the flow control and isolation device is configured to the active configuration during well shut-in; and the flow control and isolation device is configured to the passive configuration when the well is opened after a well shut-in.

17. The downhole flow control and isolation device of claim 7, further comprising:

a plurality of sensors configured to measure different process parameters.

18. The downhole flow control and isolation device of claim 7, wherein the flow control device is reprogrammable to respond to different process parameters.

19. The downhole flow control and isolation device of claim 7, wherein the target process parameter value is selected so as to maintain a surface process parameter of the well at a desired value, or within a desired range.

20. A method of operating and isolating a well, the method comprising;

locating a downhole flow control and isolation device within the well at a downhole location, wherein the device comprises a flow control valve, and a sensor in communication with the flow control valve;

operating the flow control valve in a flow control configuration in which the flow control valve is adjusted between fully open, partially open and fully closed positions, via an infinitely variable choke actuator, in response to a measured local process parameter to control a fluid flow through the valve during production from the well to achieve a target local process parameter value;

closing the well;

detecting that the measured local process parameter indicates that the well has been shut-in; and operating the flow control valve in an isolation configuration in which the flow control valve is closed to prevent flow therethrough to isolate a portion of the well at the downhole location.

* * * * *